US008308121B1

(12) United States Patent
Poplawski

(10) Patent No.: US 8,308,121 B1
(45) Date of Patent: Nov. 13, 2012

(54) PORTABLE MULTIPLE FORM ORGANIZER

(76) Inventor: Thomas J. Poplawski, North Grosvenordale, CT (US)

( * ) Notice: Subject to any disclaimer, the term of this patent is extended or adjusted under 35 U.S.C. 154(b) by 179 days.

(21) Appl. No.: 12/826,743

(22) Filed: Jun. 30, 2010

(51) Int. Cl.
*A47B 97/04* (2006.01)

(52) U.S. Cl. ..... 248/454; 248/451; 248/446; 281/45

(58) Field of Classification Search ..... 248/454, 248/455, 451, 446, 447, 452, 453; 281/45
See application file for complete search history.

(56) References Cited

U.S. PATENT DOCUMENTS

| | | | | |
|---|---|---|---|---|
| 216,657 | A | 6/1879 | Cochrane | |
| 793,978 | A * | 7/1905 | Beidler | 248/446 |
| 1,279,971 | A | 9/1918 | Bender | |
| 4,243,249 | A * | 1/1981 | Goss | 281/51 |
| 4,496,058 | A * | 1/1985 | Harris et al. | 40/308 |
| 5,145,141 | A | 9/1992 | Hunter | |
| 5,226,215 | A | 7/1993 | Evenson | |
| 5,326,147 | A * | 7/1994 | Watson | 294/162 |
| 5,487,521 | A | 1/1996 | Callahan | |
| 5,658,014 | A | 8/1997 | Barker et al. | |
| 5,746,410 | A * | 5/1998 | Hung | 248/441.1 |
| 5,855,329 | A * | 1/1999 | Pagano | 248/451 |
| 6,095,477 | A | 8/2000 | Pohlman | |
| 7,137,175 | B2 | 11/2006 | Villeneuve | |
| 7,168,672 | B2 | 1/2007 | Hsu | |
| 7,758,009 | B1 * | 7/2010 | Chang | 248/460 |

* cited by examiner

*Primary Examiner* — Terrell McKinnon
*Assistant Examiner* — Steven Marsh
(74) *Attorney, Agent, or Firm* — Montgomery Patent & Design, LLC; Robert C. Montgomery; Joseph Yaksich

(57) ABSTRACT

A portable multiple form organizer comprises a writing panel capable of supporting and securing multiple sheets of paper in a side-by-side format. A plurality of clips is spaced across a long edge of a front surface of the writing panel with suitable space between to fit a standard full sheet of paper. A mounting mechanism comprising a plurality of hooks permanently affixed to a rear surface of the writing panel allows the organizer to suspend from a support surface. A pair of arms attached to a bottom rear surface of the writing panel provides a standoff for the writing panel away from the vertical support surface, such that the writing panel is not perpendicular to the ground allowing a user to comfortably use the device.

15 Claims, 3 Drawing Sheets

PORTABLE MULTIPLE FORM ORGANIZER

RELATED APPLICATIONS

The present invention was first described in a notarized Official Record of Invention on Oct. 5, 2009, that is on file at the offices of Montgomery Patent and Design, LLC, the entire disclosures of which are incorporated herein by reference.

FIELD OF THE INVENTION

The present invention relates generally to document organizing and supporting devices, and in particular, to a portable organizer and support for multiple paper documents.

BACKGROUND OF THE INVENTION

During a typical business day, millions of parcels and items are delivered around the world. While computerized tracking, customer databases, and electronic scanning has greatly increased productivity and reduced mistakes, the great majority of these items are still tracked by various pieces of paper such as invoices, tracking forms, and the like. Often times during the order filling, tracking, and delivery process, workers will be dealing with various multiple paper forms at one (1) time. This often results in confusion, paper shuffling, and constant reorganization of the multiple papers, since only one can be read at a time on a standard clipboard or order board. Even under the best conditions, this process risks wasted time and errors and may result in wrong items being delivered or received. All of these problems add increased time and money to the process.

While clipboards are commonly used in these situations, they lack the ability to effectively display and work on several sheets of paper concurrently. Conventional clipboards include a rigid board with a clip mounted at an upper region to forcibly secure at least one (1) sheet of a paper document to the board. Typically the board is dimensioned slightly larger than a standard sheet of paper and is designed for only a single sheet to be worked on at any given time. These and similar support racks and invoice holders are designed to be held or placed upon another work surface while working on the paper document.

Various alterations and modifications have attempted to improve the functionality and usefulness of the conventional clipboard. Examples of these attempts can be seen by reference in several U.S. Patents, including: U.S. Pat. No. 1,279,971, issued in the name of Bender, which describes an invoice holder having a pair of document securing arms; U.S. Pat. No. 5,145,414, issued in the name of Hunter, which describes a clipboard having a pair of panels for receiving and viewing a document therebetween; U.S. Pat. No. 5,226,215, issued in the name of Evenson, which describes a clipboard having a variable position clip; U.S. Pat. No. 5,487,521, issued in the name of Callahan, which describes a steering wheel mounted support for computer, printed matter, food and/or beverage; U.S. Pat. No. 5,658,014, issued in the name of Barker et al., which describes a clipboard capable of being suspended on a slat wall for display; U.S. Pat. No. 7,137,175, issued in the name of Villeneuve, which describes a clipboard with dual clamping members; and, U.S. Pat. No. 7,168,672, issued in the name of Hsu, which describes a multifunctional support rack.

While these devices may accomplish their specific intended purpose, each suffers from one (1) or more disadvantage or deficiency with respect to design, function, or effectiveness. Accordingly, there exists a need for a means by which multiple paper documents, particularly those associated with order filling or the delivery process can be handled and organized in an effective and convenient manner. The development of the present invention substantially departs from the conventional solutions and in doing so fulfills this need.

SUMMARY OF THE INVENTION

In view of the foregoing references, the inventor recognized the aforementioned inherent problems and lack in the art and observed that there remains a need for device used to hold and display multiple individual or stacks of paper documents, such invoices, order forms, or delivery tickets. Thus, an object of the present invention is to solve the aforementioned disadvantages and provide for this need.

Another object of the present invention is to provide a device enables the paper documents to be more easily organized, read, and written upon.

Yet another object of the present invention is to provide a device which can be suspended from various different generally vertical support surfaces.

Yet another object of the present invention is to provide a device which can be set upon a generally horizontal support surface.

Yet still another object of the present invention is to provide a device which displays the paper documents at an enhanced viewing angle.

Yet still another object of the present invention is to provide a device which includes a means to hold associated accessories such as writing instruments or a calculator.

Yet still another object of the present invention is to provide a device which is simple and intuitive to use with little to no training.

Yet still another object of the present invention is to provide a device which is durable and economical to manufacture.

One or more of these and other objects of the invention are achieved by providing a portable multiple form organizer comprising a rigid panel for providing a writing surface including a flat front surface, a flat rear surface, an upper longitudinal edge portion, a lower longitudinal edge portion, and a pair side edge portions. A plurality of spring clamps is disposed on the panel front surface adjacent to the upper longitudinal edge portion for securing paper documents on the panel. A plurality of hooks is disposed on the panel rear surface adjacent to the upper longitudinal edge portion for suspending the form organizer from a generally vertical support surface. A pair of brackets is disposed on the panel rear surface for providing an angled standoff between the panel and the support surface.

In at least one (1) embodiment of the invention, these objectives are achieved by providing the organizer including a side rail disposed perpendicularly to each of the pair of side edge portions and a lip disposed perpendicularly to the lower longitudinal edge portion.

These objectives are also achieved by providing a method of organizing and supporting paper documents providing a portable multiple form organizer.

Furthermore, the described features and advantages of the invention may be combined in various manners and embodiments as one skilled in the relevant art will recognize. The invention can be practiced without one (1) or more of the features and advantages described in a particular embodiment.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | portable multiple form organizer |
| 11 | fork lift truck |
| 12 | guard |
| 13 | documents |
| 20 | panel |
| 22 | side rail |
| 24 | lip |
| 26 | clamp |
| 28 | hook |
| 30 | bracket |
| 35 | welding technique |

DETAILED DESCRIPTION OF THE PREFERRED EMBODIMENT

Figure 1:
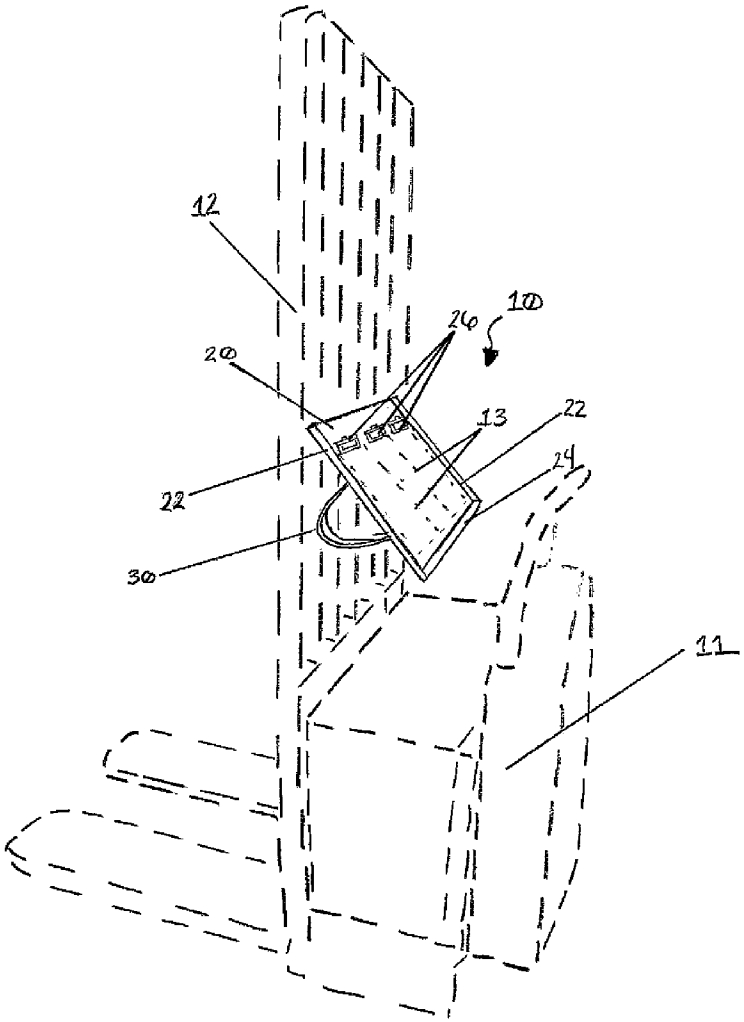
FIG. 1 is an environmental view of a portable multiple form organizer 10, according to a preferred embodiment of the present invention.
Figure 2:
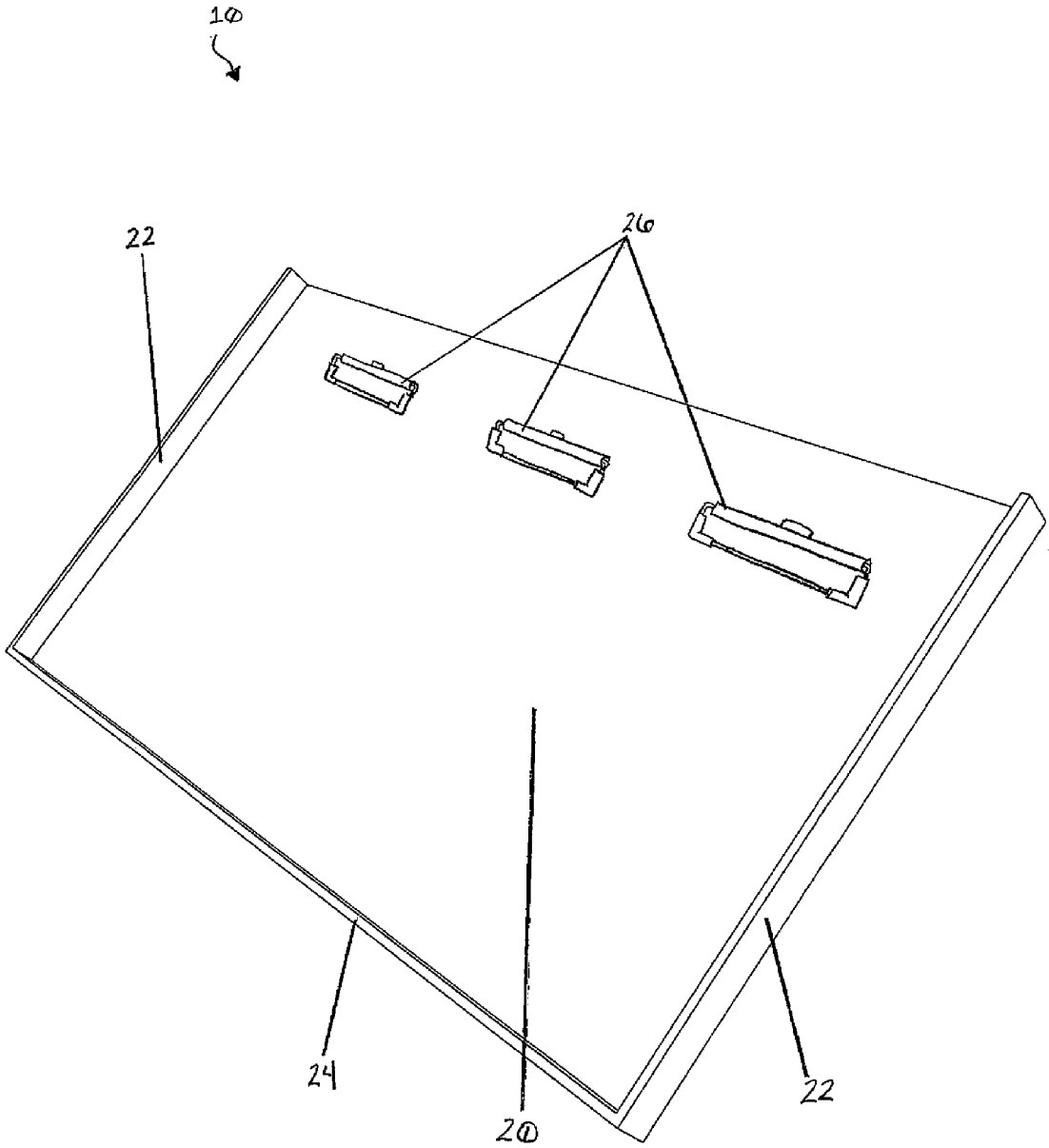
FIG. 2 is a front perspective view of the portable multiple form organizer 10, according to a preferred embodiment of the present invention; and, FIG. 3 is a rear perspective view of the portable multiple form organizer 10, according to a preferred embodiment of the present invention.
Figure 3:
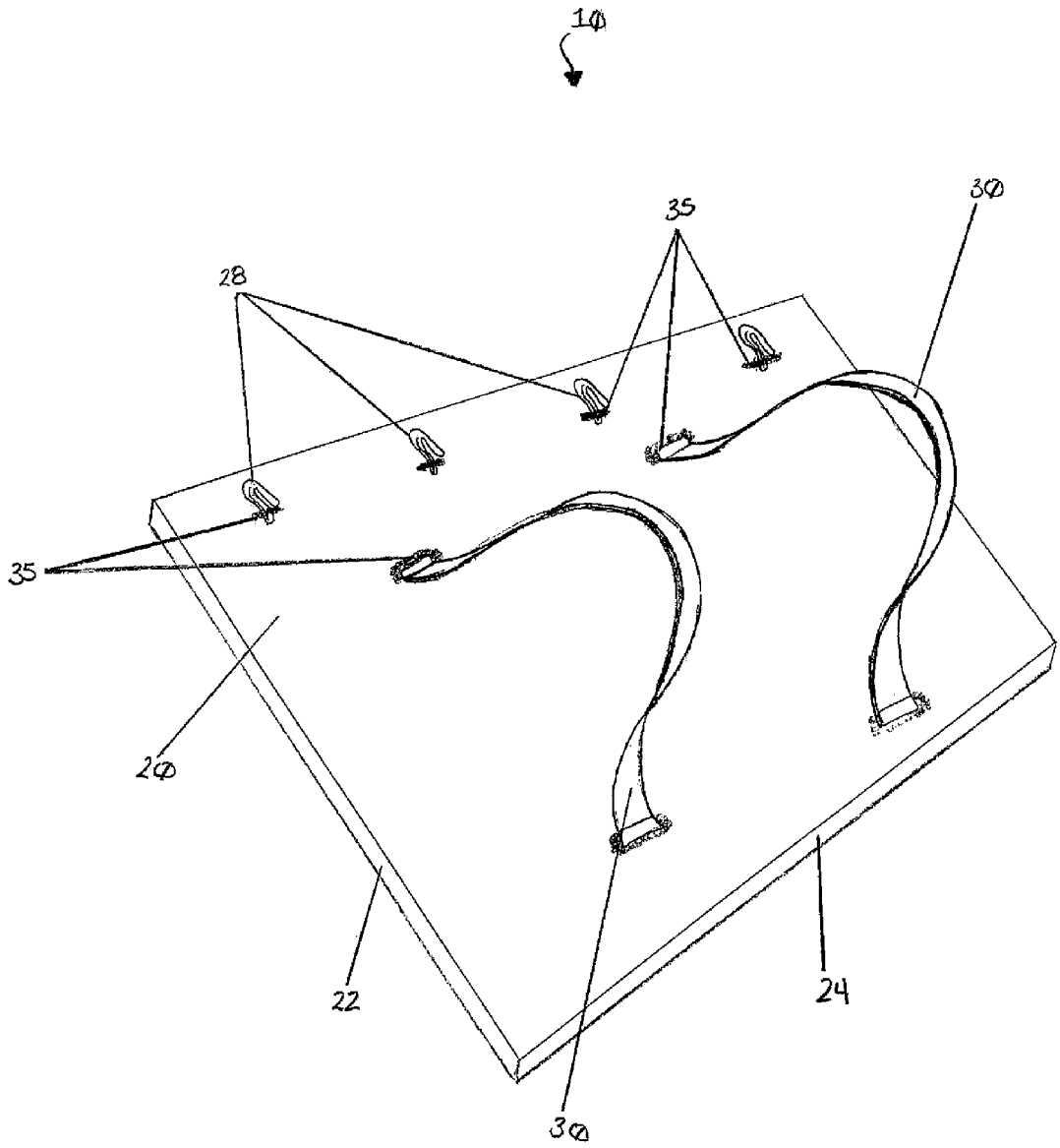

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a portable multiple form organizer (herein described as the "device") 10, which provides a means for securing a plurality of documents 13 such as, but not limited to: invoices, tracking forms, or the like to various work surfaces needed in typical delivery settings. Referring now to FIG. 1, an environmental view of the device 10, according to the preferred embodiment of the present invention, is disclosed. The device 10 is depicted as attached on a guard 12 of a conventional fork lift truck 11 for illustration purposes only and it can be appreciated by one skilled in the art that other support surfaces may be utilized such as, but not limited to: an electric jack, a delivery truck, a truck dock, or similar supports found in delivery or processing locations. The device 10 is preferably fabricated from steel, but other materials may be utilized, without limiting the scope of the device 10, and comprises dimensions approximately measuring eighteen (18) inches high by thirty-six (36) inches wide. The device 10 enables workers in the delivery occupation to easily organize and read multiple documents 13, such as forms and invoices, typically associated with the delivery process, yielding increased productivity and overall lower operating costs.

Referring now to FIG. 2, a front perspective view of the device 10, according to the preferred embodiment of the present invention, is disclosed. A front portion of the device 10 comprises a panel 20, a pair of side rails 22, a lip 24, and a plurality of clamps 26. The panel 20 provides a user with a rigid supporting means for writing or securing documents 13. Opposing outer side edges of the panel 20 each comprise a side rail 22 which is perpendicular to the panel 20. Also a lower longitudinal edge of the panel 20 comprises a lip 24 which is also perpendicular to the panel enabling items, such as writing utensils or the like, to rest against the panel 20 and lip 24. The side rails 22 and lip 24 maintain the documents 13 from sliding off of the panel 20 and also prevents the documents 13 from being misplaced.

A front surface of the panel 20 comprises a plurality of spring-loaded clamps 26 located in a parallel orientation across on upper longitudinal edge. The clamps 26 are similar in design and function to clipboard clamping mechanisms utilized to secure documents 13 against the panel 20. The clamps 26 are attached to the panel 20 via attachment means such as, but not limited to: adhesive, rivets, screws, or the like.

Referring now to FIG. 3, a rear perspective view of the device 10, according to the preferred embodiment of the present invention, is disclosed. A rear surface of the device 10 comprises a plurality of hooks 28 and a pair of brackets 30. The hooks 28 are located in a parallel orientation across an upper longitudinal edge of a rear surface of the panel 20. The hooks 28 are depicted as fastened to the rear surface of the panel 20 with common welding techniques 35, yet other fastening means may be utilized without limiting the scope of the device 10. The hooks 28 engage support surfaces such as eye bolts, guide rails, or similar supports typically found in delivery or processing locations, thereby suspending and displaying the device 10. Once suspended via the hooks 28 the device 10 is angled at a preferably forty-five degree (45°) angle, thereby enabling writing and storing of documents 13 or other items thereon.

The device 10 is angled in the preferred angle by a pair of brackets 30. The panel 20 further comprises a pair of arcuate brackets 30 affixed to the rear surface at an intermediate location to angle the device 10 once suspended from the support surface by the hooks 28. The brackets 30 enable the device 10 to be upwardly angled which enables the user to comfortably write on the documents 13 using the front surface of the panel 20 as a writing surface and to store items upon the upper surface of the panel 20. The device 10 may also be utilizing in a generally horizontal position by positioning the brackets 30 on a level surface which enables the brackets 30 to support the device 10 in a generally upright manner. The brackets 30 are depicted as fastened to the rear surface of the panel 20 with common welding techniques 35, yet other fastening means may be utilized without limiting the scope of the device 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: acquiring the device 10; engaging the hooks 28 to a desired generally vertical support structure; enabling the brackets 30 to contact the support structure and angle the panel 20; resting documents 13 against the panel 20; positioning documents 13 within the clamps 26 as desire, thereby securing the documents 13 thereto; resting desired items upon the panel 20 and lip 24; and, easily organize and read documents 13 associated with the delivery process, yielding increased productivity and overall lower operating costs.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A portable multiple form organizer comprising:

a rigid panel for providing a writing surface, said panel having a front surface and a rear surface, a generally flat rectangular member having an upper longitudinal edge portion, a lower longitudinal edge portion, and a pair of side edge portions;

a clamping means disposed on said panel front surface for securing paper documents on said panel;

a hanging means disposed on said panel rear surface capable of suspending said form organizer from a support surface; and, a pair of brackets disposed on said panel rear surface for providing an angled standoff between said panel and said support surface, each further comprising an elongated arcuate member disposed perpendicularly to said panel longitudinal edge portions.

2. The organizer of claim 1, wherein said pair of brackets is affixed in a parallel orientation at an intermediate location upon said panel rear surface.

3. The organizer of claim 2, wherein said angled standoff further comprises an angle of approximately forty-five degrees.

4. The organizer of claim 1, wherein said clamping means further comprises a plurality of spring clamps each comprising:

a support member affixed to said panel front surface;

a generally C-shaped clamping arm pivotally attached to said support member; and, a spring affixed between said support member and said clamping arm, said spring biasing said clamping arm toward contact with said panel front surface.

5. The organizer of claim 1, wherein said hanging means further comprises a plurality of hooks affixed to said panel rear surface.

6. The organizer of claim 5, wherein each of said plurality of hooks further comprises a hooked member having an affixed end, a free end opposite said affixed end, and a bend between said affixed end and said free end;

whereby said free end is generally parallel to said panel rear surface and pointed toward said lower longitudinal edge portion.

7. The organizer of claim 1, wherein said panel further comprises a side rail disposed perpendicularly to each of said pair of side edge portions.

8. The organizer of claim 1, wherein said panel further comprises a lip disposed perpendicularly to said lower longitudinal edge portion.

9. A portable multiple form organizer comprising:

a rigid panel for providing a writing surface, said panel further comprising:

a flat front surface;

a flat rear surface;

an upper longitudinal edge portion;

a lower longitudinal edge portion opposite said upper longitudinal edge portion;

a pair side of edge portions;

a side rail disposed perpendicularly to each of said pair of side edge portions; and, a lip disposed perpendicularly to said lower longitudinal edge portion;

a plurality of spring clamps disposed on said panel front surface adjacent to said upper longitudinal edge portion for securing paper documents on said panel;

a plurality of hooks disposed on said panel rear surface adjacent to said upper longitudinal edge portion for suspending said form organizer from a generally vertical support surface; and, a pair of brackets disposed on said panel rear surface for providing an angled standoff between said panel and said support surface, each further comprising an elongated arcuate member disposed perpendicularly to said panel longitudinal edge portions;

wherein said pair of brackets are affixed in a parallel orientation at an intermediate location upon said panel rear surface; and, wherein said angled standoff further comprises an angle of approximately forty-five degrees.

10. The organizer of claim 9, wherein said plurality of spring clamps each comprise:

a support member affixed to said panel front surface;

a generally C-shaped clamping arm pivotally attached to said support member; and, a spring affixed between said support member and said clamping arm, said spring biasing said clamping arm toward contact with said panel front surface.

11. The organizer of claim 9, wherein each of said plurality of hooks further comprises:

a hooked member having an affixed end affixed to said panel rear surface;

a free end opposite said affixed end; and, a bend between said affixed end and said free end;

whereby said free end is generally parallel to said panel rear surface and pointed toward said lower longitudinal edge portion.

12. The organizer of claim 9, wherein said pair of brackets each further comprises an elongated arcuate member disposed perpendicularly to said panel longitudinal edge portions;

wherein said pair of brackets are affixed in a parallel orientation at an intermediate location upon said panel rear surface;

wherein said angled standoff further comprises an angle of approximately forty-five degrees;

wherein said plurality of spring clamps each comprise:

a support member affixed to said panel front surface;

a generally C-shaped clamping arm pivotally attached to said support member; and, a spring affixed between said support member and said clamping arm, said spring biasing said clamping arm toward contact with said panel front surface; and, wherein each of said plurality of hooks further comprises:

a hooked member having an affixed end affixed to said panel rear surface;

a free end opposite said affixed end; and;

a bend between said affixed end and said free end;

whereby said free end is generally parallel to said panel rear surface and pointed toward said lower longitudinal edge portion.

13. The organizer of claim 12, wherein said longitudinal edge portions further comprise a length of approximately thirty-six inches; and, wherein said side edge portions further comprise a length of approximately eighteen inches.

14. A method of organizing and supporting paper documents, said method comprising the steps of:

providing a portable multiple form organizer comprising a rigid panel for providing a writing surface; a plurality of spring clamps disposed on a front surface of said panel for securing paper documents on said panel; a plurality of hooks disposed on a rear surface of said panel capable of suspending said form organizer from a support surface; and, a pair of brackets disposed on said panel rear surface suitable for providing a angled standoff between said panel and said support surface;

engaging said plurality of hooks to a generally vertical support surface;

resting said pair of brackets on said generally vertical support surface, thus providing said writing surface at a generally forty-five degree angle;

positioning at least one of a plurality of said paper documents on said panel front surface;

securing said at least one of a plurality of paper documents to said panel front surface by engaging an upper end of said at least one of a plurality of paper documents within at least one of said plurality of spring clamps; and, utilizing said panel as a writing surface.

15. The method of claim 14, including the additional steps of:

resting said pair of brackets on a generally horizontal support surface, thus providing said writing surface at a generally forty-five degree angle.

* * * * *